US007893789B2

(12) United States Patent
Paynter

(10) Patent No.: US 7,893,789 B2
(45) Date of Patent: Feb. 22, 2011

(54) WAVEGUIDE TRANSITIONS AND METHOD OF FORMING COMPONENTS

(75) Inventor: Jeffrey Paynter, Momence, IL (US)

(73) Assignee: Andrew LLC, Hickory, NC (US)

( * ) Notice: Subject to any disclaimer, the term of this patent is extended or adjusted under 35 U.S.C. 154(b) by 647 days.

(21) Appl. No.: 11/637,478

(22) Filed: Dec. 12, 2006

(65) Prior Publication Data

US 2008/0136565 A1 Jun. 12, 2008

(51) Int. Cl.
*H01P 1/16* (2006.01)

(52) U.S. Cl. ..... 333/21 R; 333/248

(58) Field of Classification Search ..... 333/21 R, 333/33–34, 248

See application file for complete search history.

(56) References Cited

U.S. PATENT DOCUMENTS

| | | | | |
|---|---|---|---|---|
| 3,388,352 | A | 6/1968 | Ramonat | |
| 3,686,595 | A | 8/1972 | Spinner | |
| 3,818,383 | A * | 6/1974 | Willis | 333/21 R |
| 3,928,825 | A | 12/1975 | Kaffenberger | |
| 3,988,702 | A * | 10/1976 | Kaffenberger | 333/33 |
| 4,356,495 | A * | 10/1982 | Morz | 343/786 |
| 4,491,810 | A | 1/1985 | Saad | |
| 4,540,959 | A | 9/1985 | Saad | |
| 4,553,112 | A | 11/1985 | Saad | |
| 4,636,689 | A | 1/1987 | Mourier | |
| 4,642,585 | A | 2/1987 | Saad | |
| 5,398,010 | A | 3/1995 | Klebe | |
| 5,734,303 | A | 3/1998 | Baca | |
| 5,886,588 | A | 3/1999 | Schneider | |
| 5,937,509 | A * | 8/1999 | Tokuda et al. | 29/600 |
| 6,130,586 | A | 10/2000 | Schulz | |
| 6,560,850 | B2 | 5/2003 | St. John | |
| 6,583,693 | B2 | 6/2003 | Paynter | |
| 6,661,305 | B1 | 12/2003 | Rosenberg | |
| 6,839,037 | B1 * | 1/2005 | Stokes et al. | 343/786 |
| 2006/0196626 | A1 | 9/2006 | Decker et al. | |

FOREIGN PATENT DOCUMENTS

| | | |
|---|---|---|
| DE | 27 37 125 A1 | 2/1979 |
| DE | 38 36 454 A1 | 5/1990 |
| DE | 197 39 589 A1 | 3/1999 |
| DE | 199 37 725 A1 | 2/2001 |

(Continued)

OTHER PUBLICATIONS

Apr. 25, 2008 European Patent Office communication concerning the partial European Search Report (5 pages).

(Continued)

*Primary Examiner*—James Cho
(74) *Attorney, Agent, or Firm*—Husch Blackwell LLP

(57) ABSTRACT

A waveguide transition for transitioning from an overmoded waveguide to another waveguide is provided, where one end of the waveguide is configured to connect to a rectangular waveguide and the other end is configured to connect to an elliptical waveguide. The transition has an internal shape having top and bottom walls and two side walls. The top and bottom walls are shaped to join smoothly with waveguides at each end of the transition, while the side walls diminish in height along the length of the transition. The waveguide transition may employ mode filtering to suppress unwanted higher modes. A method of forming waveguide components is also disclosed, involving thixoforming of components in single pieces, the components having internal shapes configured for mold core removal.

28 Claims, 7 Drawing Sheets

FOREIGN PATENT DOCUMENTS

| | | | |
|---|---|---|---|
| EP | 0 309 850 | B1 | 8/1993 |
| EP | 0 802 576 | A | 10/1997 |
| EP | 0 903 193 | A | 3/1999 |

OTHER PUBLICATIONS

Nov. 13, 2008 European Patent Office communication concerning the extended European Search Report (14 pages).

Nov. 18, 2009 European Patent Office Communication regarding "Summons to attend oral proceedings pursuant to Rule 115(1) EPC" in connection with foreign Application No. EP 07122734.2 (8 pages).

RFS "Flexwell Elliptical Waveguide"—Microwave Antenna Systems (4), pp. 347-369, www.rfsworld.com (23 pages).

* cited by examiner

WAVEGUIDE TRANSITIONS AND METHOD OF FORMING COMPONENTS

FIELD OF THE INVENTION

The invention relates to waveguide components, including waveguide transitions for transitioning between a first waveguide and a second waveguide, and to methods of forming such components.

BACKGROUND TO THE INVENTION

Waveguides are commonly used in a number of applications and are particularly suited for transmission of signals in the microwave frequency range. This transmission may be between an antenna, often mounted on a tall tower, and base station equipment located in a shelter at ground level, for example. In general, a waveguide consists of a hollow metallic tube of defined cross-section. Commonly used cross-sectional shapes include rectangular, circular and elliptical.

Each waveguide has a minimum frequency for transmission of signals (the "cut off frequency"). This frequency is primarily a function of the dimensions and cross-sectional shape of the particular waveguide, and is different for different wave modes.

In a dominant mode waveguide, the frequency range of operation of the waveguide is selected such that only the fundamental wave mode (the "dominant mode") can be transmitted by the waveguide. For example, in a rectangular dominant mode waveguide, the frequency range of operation is typically between 1.25 and 1.9 times the cut off frequency of the dominant mode (the $H_{10}$ mode). In a typical rectangular waveguide, where the aspect ratio is generally about 0.5, higher order wave modes (e.g. the $H_{01}$ and $H_{20}$ modes) are transmitted only above two times the cut off frequency of the dominant wave mode. Thus, this restriction of the frequency range of operation prevents propagation of any wave mode other than the dominant wave mode.

In an overmoded waveguide, the signal frequency is significantly higher than the cut off frequency. For example, in some overmoded elliptical waveguides, the signal is transmitted in the $H_{C11}$ mode, with a frequency range between 2.43 and 2.95 times the cut off frequency for that mode. In general, this means that an overmoded waveguide has a cross-sectional area that is significantly larger than that of a dominant mode waveguide operating in the same frequency range. The principal reason for using overmoded waveguides is that, as the frequency of the signals increases above the fundamental mode cut off frequency, attenuation of the signals decreases. This decreased attenuation makes use of overmoded waveguides beneficial in some applications despite the problems with these waveguides, described below.

The difference between the signal frequency and the cut off frequency in an overmoded waveguide also means that one or more higher modes are able to propagate in the waveguide, since the operating frequency range is greater than the cutoff frequencies of those modes. It is a significant challenge to operate an overmoded waveguide without disturbing the signal (i.e. the fundamental mode). Any disturbance of this signal may result in the conversion of fundamental mode signals to unwanted higher modes, these unwanted modes propagating in the waveguide and converting back to fundamental mode signals. As the different modes travel at different velocities within the waveguide, such conversion and reconversion back and forth between the modes is a problematic source of noise and signal distortion.

Therefore, it is desirable to minimize mode conversion within the overmoded waveguide, and in particular at any discontinuities in the waveguide structure. Design of transitions for transitioning between an overmoded waveguide and another waveguide is therefore particularly important.

Waveguides are typically coupled at some point. Generally, standard interfaces are dominant moded, so that any system using overmoded waveguide will generally need a first transition from a first (dominant mode) standard interface to overmoded waveguide, and a second transition from overmoded waveguide to a second (dominant mode) standard interface. The coupling systems are critical to successful operation of the waveguide system and a number of different transitions, with a number of different internal shapes, have been used for transitioning between waveguides.

One prior transition for connecting a rectangular dominant mode waveguide to an elliptical overmoded waveguide consists of a straight elliptical cylinder intersecting a tapered rectangular pyramid. The elliptical cylinder has dimensions roughly matching those of the overmoded waveguide, while the rectangular pyramid matches the dimensions of the dominant mode waveguide at one end and broadens linearly until it intersects the ellipse. The straight tapers and abrupt changes in angle cause significant generation of unwanted higher modes.

This transition also uses a mode filter supported by slots running along the transition's internal walls. The mode filter uses a resistive element such as carbon or another resistive pigment that has been printed on a dielectric substrate. The resistivity of the coating is around 1000 Ohms/square.

In general, it is difficult to transition between a dominant mode waveguide and an overmoded waveguide because of the large difference in dimensions of the two waveguides and the need to avoid excessive mode conversion. The transition is one of the largest sources of mode conversion and therefore of signal distortion in the waveguide system.

Waveguide components such as waveguide transitions, joints, bends and the like may be formed by electroforming. This process involves electro-deposition of metal through an electrolytic solution onto a metallic surface (the mandrel). A sufficient amount of material is deposited to form a self supporting structure with a surface which matches the mandrel surface very accurately. Modern numerical control technology allows accurate fabrication of mandrels, so that very precisely engineered components can be made.

However, manufacture by this process has been expensive and requires several additional fabrication steps, including trimming and machining steps such as formation of apertures for coupling, o-ring grooves and means to support a mode filter. Therefore, components produced by this method are expensive. The material generally used is copper-based, adding further to the cost. This material is also relatively heavy. Components have also been fabricated in two or more parts. However, this requires expensive assembly procedures and also creates a discontinuity on the internal surface of the waveguide assembly where the two pieces are joined.

It would therefore be desirable to produce a waveguide transition for use with an overmoded waveguide, which results in low mode conversion.

It would also be desirable to produce a waveguide transition for use with an overmoded waveguide which provides effective filtering of higher modes.

It would also be desirable to provide a simple and cost effective method of forming a waveguide component.

EXEMPLARY EMBODIMENTS

In a first aspect the invention provides a waveguide transition for transitioning from a rectangular waveguide to an elliptical waveguide, at least one of the waveguides being an overmoded waveguide, the transition having a transition passage, said transition passage including:

a rectangular end having a rectangular cross-section and an elliptical end having an elliptical cross-section, at least one of the rectangular and elliptical ends having a cross-section dimensioned to support overmoded transmission; and internal top, bottom and side walls connecting the rectangular end and the elliptical end; wherein:

the cross-sectional shape of the top and bottom walls varies continuously between straight at the rectangular end and semi-elliptical at the elliptical end;

the top and bottom walls are shaped to join smoothly with a passage of rectangular cross-section at the rectangular end and with a passage of elliptical cross-section at the elliptical end;

the cross-sectional shape of the side walls is straight or convex at all points between the rectangular end and the elliptical end, the height of the side walls diminishing continuously along the length of the transition, being larger at the rectangular end than at the elliptical end; and the side walls are shaped to join smoothly with a passage of rectangular cross-section at the rectangular end.

In a further aspect the invention provides a cast structure sized and configured for guiding or coupling electromagnetic waves, the structure being formed in a single piece by thixoforming a metallic material and having an internal shape configured for removal of a mold core.

In another aspect the invention provides a waveguide transition configured to receive at a rectangular input dominant mode frequency transmissions and to produce at an elliptical or other oval output overmoded frequency transmissions, said waveguide transition comprising:

a body defining an internal shape having:

a main "z" axis running from an input end to an output end;

a rectangular cross-sectional shape at said input end with width "x" and height "y" axes; and an elliptical or other oval cross-sectional shape at said output end elongated along said "x" axis;

upper and lower walls being concave and transitioning between said input end and said output end and being characterized by a first derivative of each of the upper and lower walls in the y-z plane being substantially zero at the input and output ends, and by a second derivative of each of the upper and lower walls in the y-z plane changing sign between the input and output ends;

sidewalls flaring outwardly from the input end to the output end characterized by a first derivative of each of the sidewalls in the x-z plane being substantially zero at the input end, the sidewalls reducing in height at the output end as the concave upper and lower walls merge;

wherein the cross-section of the internal shape at the input end is dimensioned to support dominant mode transmission in a frequency range and the cross-section of the internal shape at the output end is dimensioned to support overmoded transmission in the frequency range, providing lower signal attenuation compared with dominant mode transmissions.

In a further aspect the invention provides a waveguide transition comprising a casting defining an internal passage extending therethrough having a first end of rectangular cross-section and a second end of non-rectangular cross-section, the cross-section of said passage at one of the first and second ends being shaped and dimensioned to support dominant mode transmissions at a signal frequency, and the cross-section of said passage at the other of the first and second ends being shaped and dimensioned to support overmoded transmissions at the signal frequency; and a resistive mode filter mounted within said passage and configured and positioned to suppress unwanted higher modes more than signals at the signal frequency.

In another aspect the invention provides a method of forming a waveguide transition, the method comprising:

thixoform casting a waveguide transition having a first end and a second end and an internal transition passage between the first end and the second end, the cross-section of said transition passage at one of the first and second ends being shaped and dimensioned to support dominant mode transmissions in a signal frequency range, and the cross-section of said transition passage at the other of the first and second ends being shaped and dimensioned to support overmoded transmissions in the signal frequency range; and establishing within said transition passage a mode filtering structure capable of suppressing unwanted higher modes within said transition passage more than fundamental mode transmissions.

In a further aspect the invention provides a method of forming a waveguide component, the method comprising:

thixoform casting the component in a single piece from a metallic material, an internal passage of the component being configured for removal of a mold core.

BRIEF DESCRIPTION OF THE DRAWINGS

The invention will now be described by way of example only, with reference to the accompanying drawings, in which.

DETAILED DESCRIPTION

Figure 1:
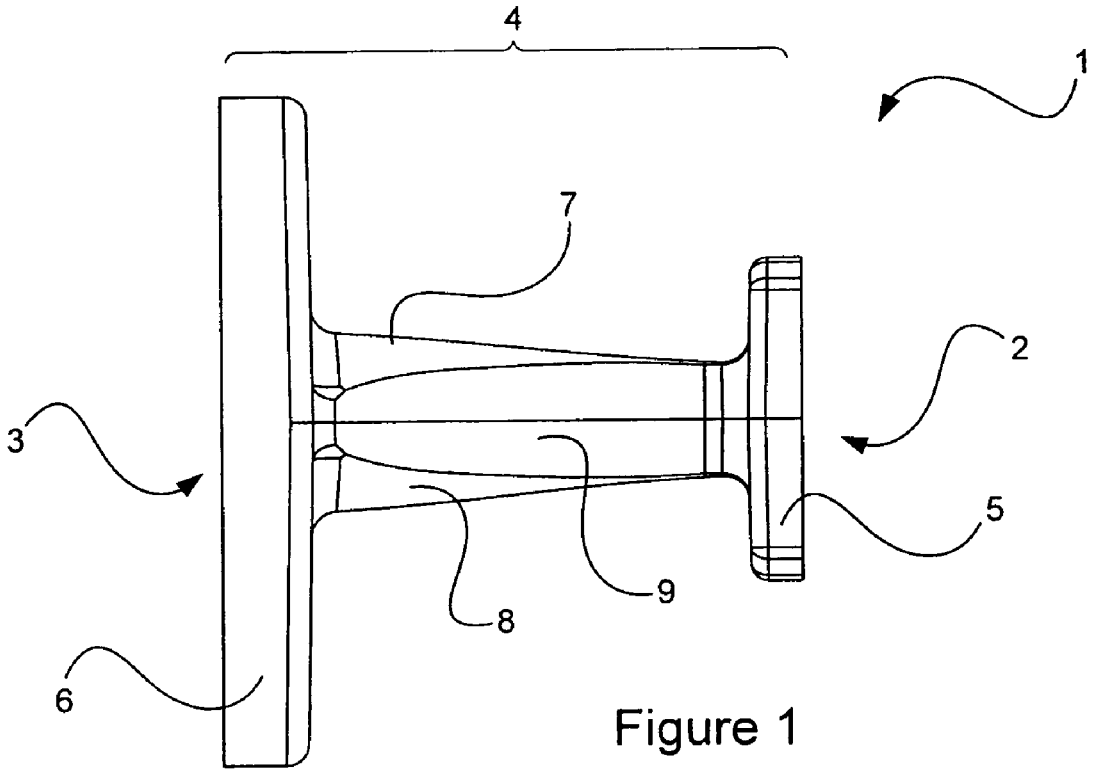
FIG. 1 is a side view of a waveguide transition according to one embodiment.

In one embodiment the invention provides a waveguide transition having an internal opening which transitions from a cross-section with shape and dimensions at one end supporting only dominant mode propagation ("the dominant mode end") to a cross-section at the other end with shape and dimensions supporting overmoded transmission ("the overmoded end").

In use, a signal in the dominant mode propagates in a waveguide connected to the dominant mode end. The waveguide transition converts this signal to an overmoded transmission at the overmoded end, the signal then traveling into an overmoded waveguide connected to the overmoded end. The frequency of the signal remains unchanged (ignoring conversion to higher order modes in the overmoded waveguide and overmoded end of the transition).

In this specification, the term "overmoded transmission" means the signal transmitted in an overmoded waveguide in the fundamental mode. The higher modes inevitably also propagating in the overmoded waveguide are referred to as the higher modes or unwanted modes. In this specification, the term "dominant mode transmission" refers to transmission within the dominant mode waveguide. Thus, both overmoded transmissions and dominant mode transmissions are generally propagated in the fundamental of the particular waveguide, although the electric field patterns of these two fundamentals may be different.

The cross-sectional shape and dimensions of the overmoded end provide reduced signal attenuation compared to a dominant mode waveguide over the same frequency range. However, the overmoded end, like an overmoded waveguide, also allows unwanted higher modes to exist. As the signal passes from the dominant mode end to the overmoded end, and the dimensions of the transition passage increase, an increasing number of modes are able to propagate.

In a waveguide system including an overmoded waveguide there is generally a similar transition at each end of a length of overmoded waveguide. Only the fundamental mode may pass into or out of this system because of the constriction formed by each transition, with only the fundamental mode able to propagate through the dominant mode end of the waveguide transition. This creates a cavity for higher order modes. In the overmoded part of the system, the fundamental signal energy can be converted into higher order modes, which then are reflected inside this cavity, adding in phase. Some of the higher order mode energy may convert back to the fundamental mode causing undesirable signal distortion. The primary mechanism for converting between the fundamental mode and higher order modes is the transition shape. This shape may be chosen to minimize such mode conversion. Other sources of mode conversion include discontinuities in the waveguide system and bending of the overmoded waveguide.

To further reduce signal distortion a mode filter may be used. This filter is designed and positioned to take advantage of the difference in field configuration between the modes, with the aim of leaving the fundamental mode relatively unaffected while many of the higher order modes experience a high level of attenuation, thus reducing the level of these unwanted higher modes.

FIG. 1 is a side view of a waveguide transition 1. The transition is suitable for use with waveguides operating in microwave frequencies, including waveguides operating between 26.5 and 40 GHz. Similar transitions may also be suitable for use with other frequency ranges.

The transition includes a rectangular end 2, an elliptical end 3 and a transition body 4 connecting the rectangular end 2 and the elliptical end 3. The transition body 4 includes a top wall 7, a bottom wall 8 and two side walls 9 (of which only one is visible in FIG. 1).

Figure 2:
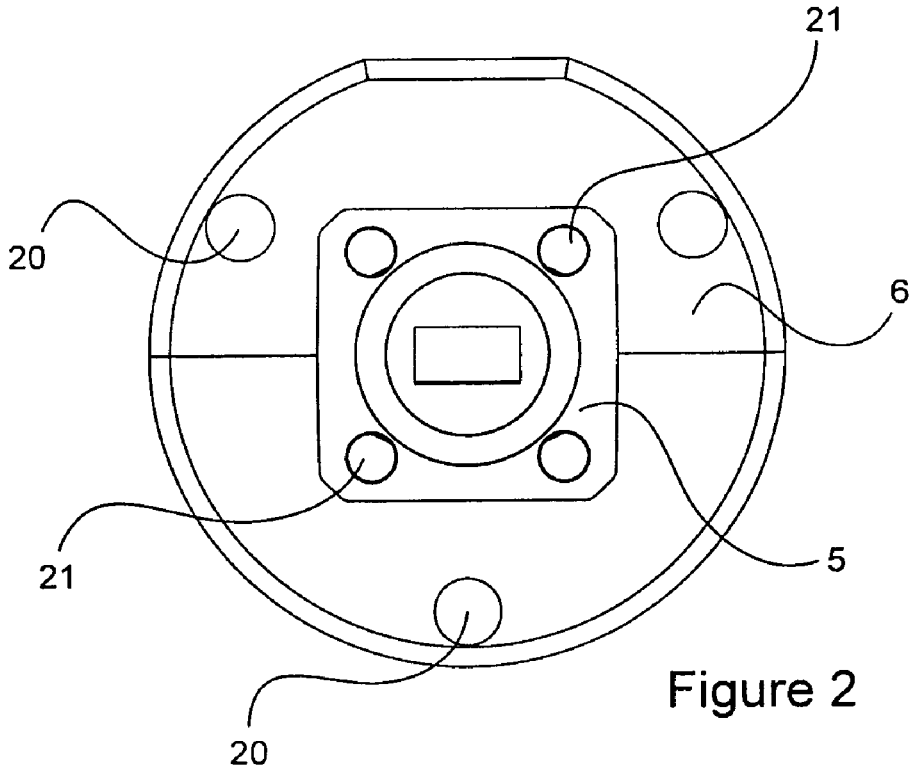
FIG. 2 is an end view of the waveguide transition of FIG. 1.

The rectangular end 2 may have a rectangular flange 5 for connecting the transition to a rectangular dominant mode waveguide. Similarly, the elliptical end 3 may have a circular flange 6 for connecting the transition to an elliptical overmoded waveguide. If provided, the flanges 5, 6 may be suitably apertured and devised for conventional bolted coupling, with gasket seals (omitted from the drawing) provided for gas-tight connections to the waveguides. FIG. 2 is a plan view of the transition of FIG. 1, from the rectangular end 2, showing the rectangular and circular flanges 5, 6 and the apertures 20, 21 for coupling to waveguides.

Figure 3:
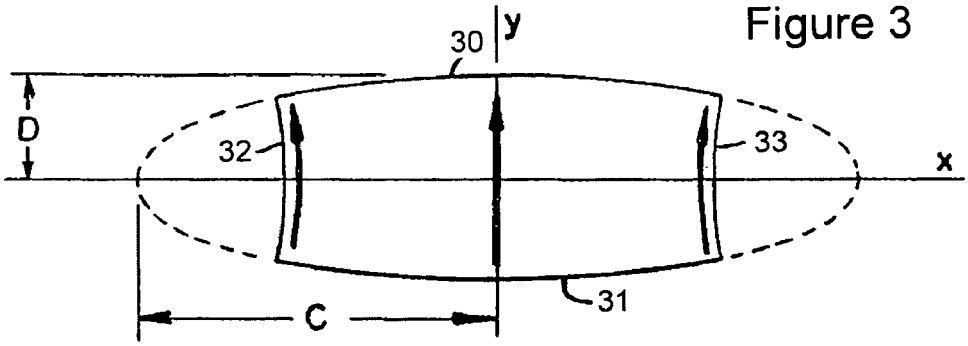
FIG. 3 is a plot of a generalised waveguide transition cross-section.

The internal shape of the waveguide transition will now be discussed. FIG. 3 is a generalized diagram of a cross-sectional shape of a transition passage. This cross-sectional shape is the internal shape of a transition at a point between the rectangular end and the elliptical end. The transition at this point has a top wall 30, a bottom wall 31 and two side walls 32, 33, all shown in solid lines. The top and bottom walls 30, 31 are concave when viewed from the interior of the waveguide transition, while the side walls 32, 33 are convex. Throughout the specification and claims, the terms "concave" and "convex" refer to shapes as viewed from the interior or axis of the transition, not as viewed from the outside of the transition.

This cross-sectional shape provides an improved transition from the dominant mode electromagnetic field pattern of the dominant-mode rectangular waveguide to the electromagnetic field pattern of the overmoded elliptical waveguide. The improvement provided by this shape can be understood from the configurations of electric field vectors within the transition. The electric field pattern in the centre of the transition is aligned with the y axis in FIG. 3. This is the same in the dominant mode rectangular waveguide and in the overmoded elliptical waveguide. Electric field vectors along the transition axis therefore remain constant in direction along the length of the transition.

On the other hand, the electric field pattern near the sides of the waveguide transition changes markedly along its length. The side walls 32, 33, which intersect perpendicularly with the top and bottom walls 30, 31 provide a smooth transition between the extremely curved electrical field which exists in this region in the overmoded elliptical waveguide and the straight electric field vectors, parallel to the y axis, which exist in this region in the dominant mode rectangular waveguide.

The side walls 32, 33 are shown as perpendicular to the top and bottom walls 30, 31 at the points of intersection. This shape is somewhat difficult to fabricate, although the fabrication method set out below facilitates fabrication of such difficult features. However, it has been found that the ideal shape shown in FIG. 3, with convex side walls, is generally approximated in performance by the shape shown in FIG. 4, with straight side walls and the same concave top and bottom walls 30, 31. The smoothness of the transition is practically attained by avoiding concavity of the side walls. That is, the side walls should be straight or convex, with either of the cross-sectional shapes of FIGS. 3 and 4 being suitable and with convex side walls providing a small benefit over straight side walls. Although the side walls may be described below as straight, convex side walls are also within the scope of the invention.

Figure 4:
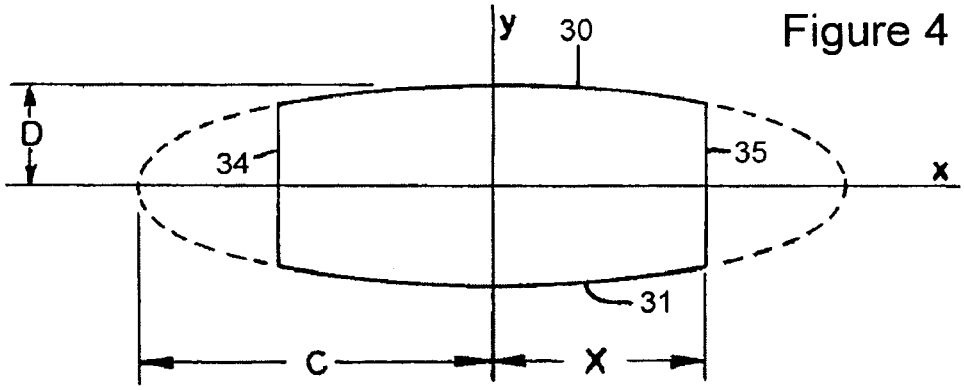
FIG. 4 is a plot of another generalised waveguide transition cross-section.

The concave top and bottom walls 30, 31 may be elliptical arcs (arcs from the circumference of an ellipse) as shown by the dotted lines in FIGS. 3 and 4, and may be taken from an ellipse having a major axis of length 2C and a minor axis of length 2D. As shown in FIGS. 3 and 4, with the origin at the centre of the transition, the semi-minor axis D corresponds to the y coordinates at the centre of the transition (x=0). The width of the transition passage, or the spacing between the side walls, is 2X.

Both a rectangle and a full ellipse may be considered as limiting cases of the geometry generalized in FIGS. 3 and 4. The rectangular end of the transition, of width A and height B, is formed by the generalized shape of FIG. 4 with D equal to one half B, with C infinite and with X equal to one-half A. At the elliptical end, the parameters C and D are the semi-axes of the ellipse at this end, and X is equal to C. At the elliptical end, the side walls 34, 35 are of zero height (or non-existent), as will become clear below.

In a waveguide transition from a rectangular waveguide of cross-sectional dimensions A and B to an elliptical waveguide of major and minor axes 2*a* and 2*b*, intermediate cross-sections of the passage along the transition may desirably employ successive intermediate values of C, D and X between these limiting values, so that the cross-section varies continuously along the length of the transition. The top and bottom walls at any point along the length may conform to the ellipse equation:

$$(x^2/C^2)+(y^2/D^2)=1$$

with C infinite at the rectangular end and equal to a at the elliptical end, and with D equal to one-half B at the rectangular end and equal to b at the elliptical end. The side walls may be spaced by 2X, with 2X equal to the rectangle width at the rectangular end and to the major axis at the elliptical end.

Monotonic variation of these quantities along the length of the transition is of course desirable for optimal performance. However, it is also desirable to avoid any angular discontinuities, such as those which result if the tapering along the transition is linear, as employed in some prior art transitions. This linear taper causes a discontinuity at each end of the transition. Such discontinuities cause mode conversion and therefore should be avoided.

Figure 5:
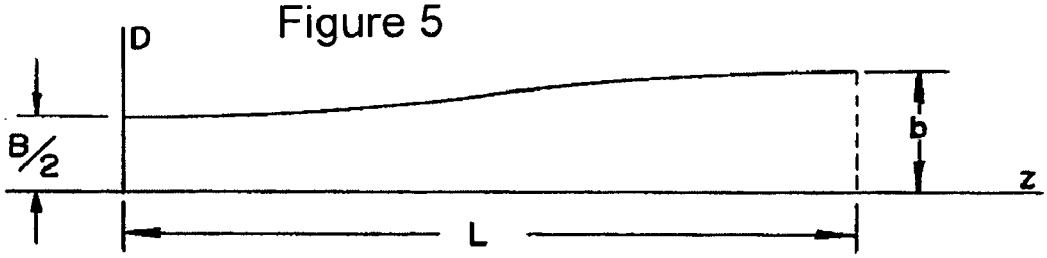
FIG. 5 is a plot showing variation in the E plane dimension along a waveguide transition.
Figure 6:
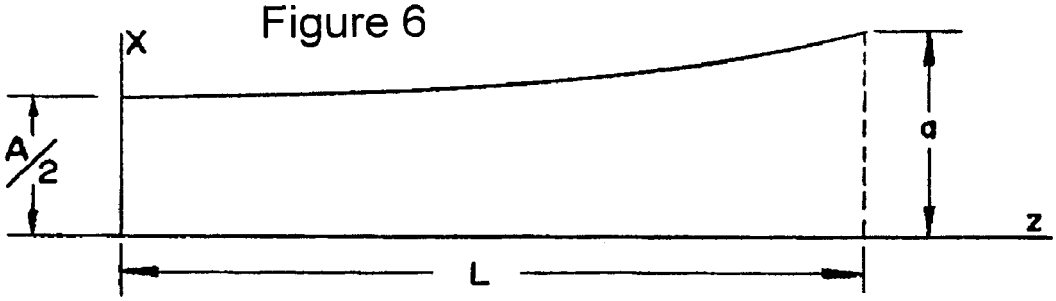
FIG. 6 is a plot showing variation in the H plane dimension along a waveguide transition.

FIGS. 5 and 6 show examples of D and X respectively, as a function of z, the distance along the transition from the rectangular end towards the elliptical end, where the total length of the transition is L. These plots correspond to the configurations of the transition in the E plane (FIG. 5) and the H plane (FIG. 6).

In general, an overmoded waveguide will have dimensions larger than a dominant mode waveguide operating at the same signal frequency, so the dimensions of the transition generally increase along its length. A dominant mode rectangular waveguide generally also has a wider signal frequency range than an elliptical waveguide. This means that several different types of elliptical waveguide may be suitable for coupling to a rectangular waveguide. Where a rectangular dominant mode waveguide of dimensions about 0.28" by 0.14" is to be coupled to an overmoded elliptical waveguide, the overmoded waveguide may have major and minor axes of about 0.508" and 0.310" respectively. Selection of waveguides to be coupled is well understood in the art and the dimensions of the transition may be selected based on the waveguides selected.

FIG. 5 shows the smoothness of the transition in the E plane. This function is non-linear, and may have a first derivative which is zero at each end of the transition and a second derivative which changes sign at some intermediate point along the length of the transition. So the top and bottom walls may be parallel to the transition axis at each end. When a waveguide is connected to the transition, the top and bottom walls of the transition passage may join smoothly with the internal walls of the waveguide.

FIG. 6 shows the transition in the H plane. Again, the transition is non-linear, and may have a zero first derivative at the rectangular end (z=0), so that the side walls join smoothly with the internal walls of a rectangular waveguide connected to the transition. The transition may also have a zero first derivative at the elliptical end (z=L), but this is not necessary if the height of the side walls tapers to zero at this point. Although the angle of the side wall at this point would appear to create a discontinuity, this is in fact not the case if the height of the side walls is zero. Thus, the discontinuity is apparent rather than real where the side walls taper in this way.

The general shaping described above may be accomplished with a number of different implementations. However, one possible implementation will now be discussed. The following formulae governing the shape of the transition have been found suitable:

$$C=a/\sin(\pi z/2L)$$

$$D=(B/2)\cos^2(\pi z/2L)+b\sin^2(\pi z/2L)$$

$$X=a-(a-A/2)\cos(\pi z/2L)$$

where the various variables and parameters are defined above.

The values of C and D calculated using these equations may be used in the ellipse equation given above, to determine a sufficient number of cross-sections for fabrication. These values may be used in a numeric control (NC) system for accurate fabrication of a mold.

Thus, the cross-sectional shape of the top and bottom walls may vary continuously between straight at the elliptical end and semi-elliptical at the elliptical end. In other words, each of the top and bottom walls may be in the form of an elliptical arc, with the arc taken from an ellipse satisfying the ellipse equation and the eccentricity of the ellipse decreasing along the length of the transition.

The length of the transition may be selected by any conventional means. In general, the longer the transition the lower the voltage standing wave ratio (VSWR). Also, since a longer transition provides a less abrupt transition, a longer transition will cause a lower level of mode conversion than a short transition.

Figure 7:
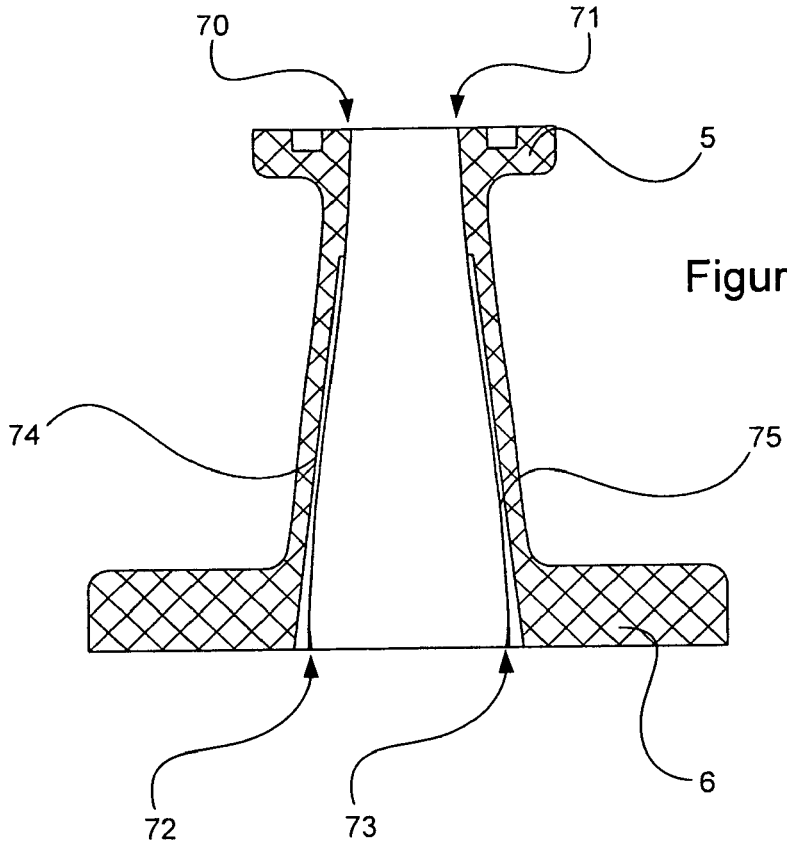
FIG. 7 is a cross-section of the waveguide transition of FIG. 1.

FIG. 7 shows an exemplary cross-section of the transition in the H plane (i.e. the long dimension of the transition passage lies in the plane of the paper). This shows the form of the side walls, which may be shaped at points 70, 71 to join smoothly with a rectangular dominant mode waveguide at the rectangular end. In the transition shown in FIG. 7, the side walls are also shaped at points 72, 73 to join smoothly with an elliptical overmoded waveguide at the elliptical end (although this shaping is optional, as discussed above). In general, the side walls are smooth along their lengths, without any discontinuities which would cause undesirable mode conversion.

FIG. 7 also shows a pair of slots 74, 75 formed in the side walls. These slots may be centered on the H plane and are configured to receive a mode filter, such as that described below.

Figure 8:
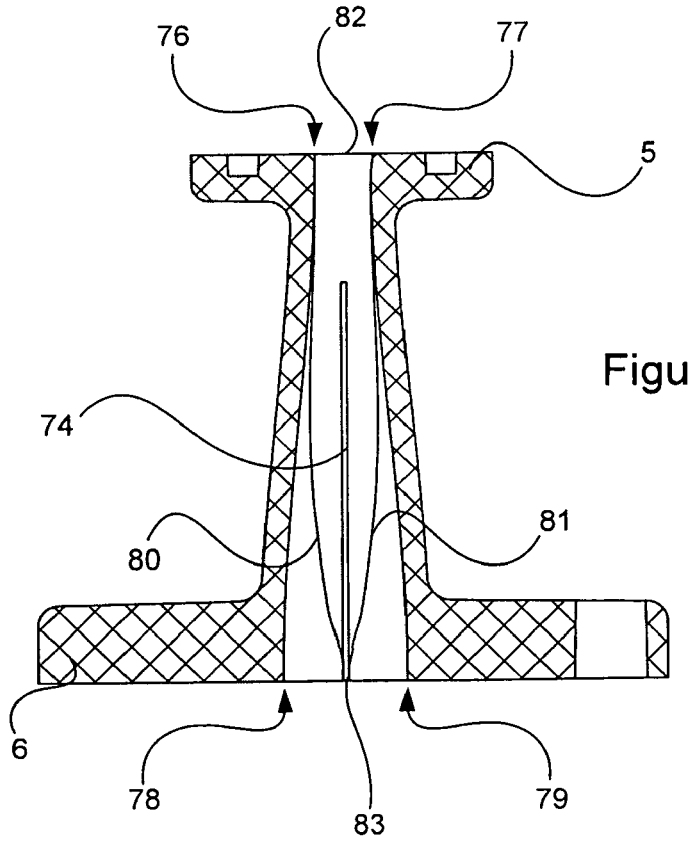
FIG. 8 is a further cross-section of the waveguide transition of FIG. 1.

FIG. 8 shows an exemplary cross-section of the waveguide transition in the E plane (i.e. the short dimension of the transition passage lies in the plane of the paper). This shows the form of the top and bottom walls, which may be shaped at points 76, 77 to join smoothly with a rectangular dominant mode waveguide at the rectangular end. The top and bottom walls may also be shaped at points 78, 79 to join smoothly with an elliptical overmoded waveguide at the elliptical end. This Figure also shows the shape of the side walls and the slot 74 projected onto the cross-section. The height of the side walls (indicated by lines 80, 81) may taper continuously along the length of the transition, from the height of the rectangle at point 82 at the rectangular end, to zero at point 83 at the elliptical end.

Figure 9:
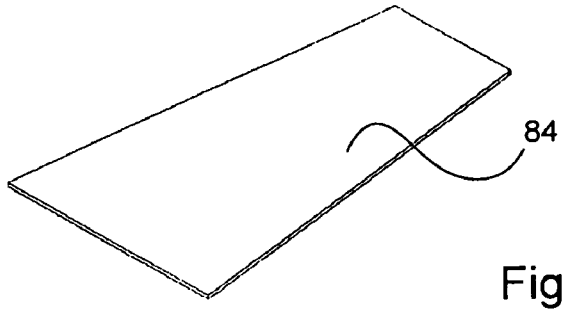
FIG. 9 is a perspective view of a mode filter card.
Figure 10:
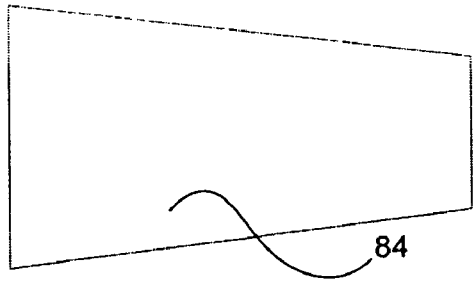
FIG. 10 is a plan view of the mode filter card of FIG. 8.

An exemplary mode filter card is shown in FIG. 9 (in a perspective view) and FIG. 10 (in a plan view). The mode filter card 84 may be generally trapezoidal in shape, matching the shape of the slots 74, 75 (as can be seen in FIG. 7) such that the card 84 is easily fitted into the slots 74, 75 but is snugly retained therein. However, any suitable shape of the slots and of the mode filter card may be used, with these two shapes generally cooperating to allow positioning and retention of the mode filter card.

Figure 11:
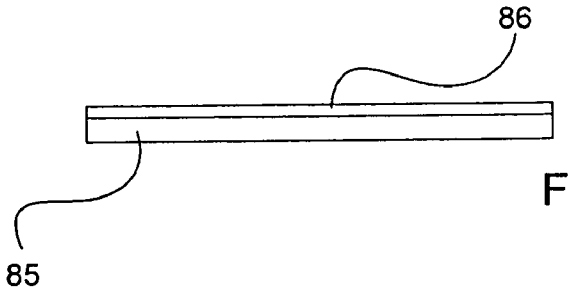
FIG. 11 is a side view of the mode filter card of FIG. 8.

Such a mode filter may consist of a resistive card, such as a mylar substrate 85 with a resistive coating 86 as shown in FIG. 11. The coating 86 may be a metallic coating and may be sputtered or vacuum deposited on to the substrate 85. The resistive material 86 may be made to Florida RF Labs specifications and may be deposited in a single process rather than in layers. The resistive coating may have a resistivity of between 100 ohms/square and 1000 ohms/square and may be formed of chrome and nickel, or an absorptive coating such as carbon. Any resistive material may be suitable. The resistivity of the coating may be chosen such that there is an adequate absorption of the higher-order modes without causing an unacceptable absorption of the dominant mode. The resistivity required may depend on the total length of the mode filter, and/or other system parameters.

The abrupt edges of the mode filter may also generate modes. The superior design of the Applicant's transition gives it a performance without any mode filters which is close to the performance of some prior art connectors with filters for certain lengths of cable.

The resistive material of the mode filter may also be patterned during deposition, etched or otherwise processed to provide any suitable pattern of resistive material. For example, the mode filter card could be patterned such that the resistive material is positioned adjacent the transition's side walls, with a clear strip running down the middle of the mode filter card.

The substrate material 85 could be any suitable dielectric such as mylar, fiberglass, mica, etc. The substrate material chosen should be able to withstand the temperatures generated in the waveguide transition and in the resistive material.

Figure 12:
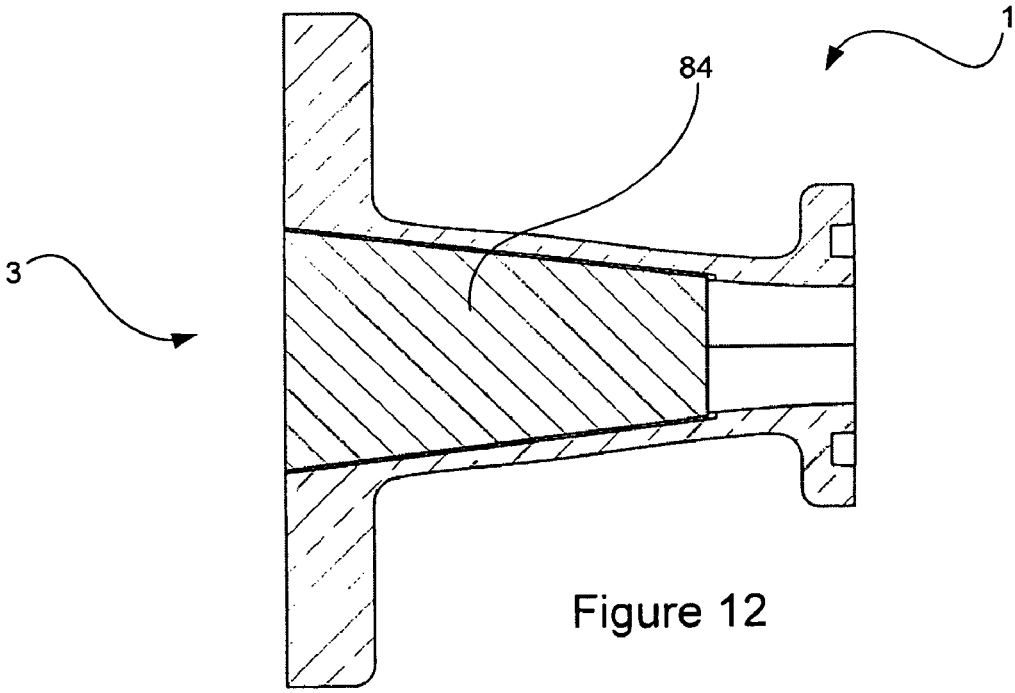
FIG. 12 is a cross-section of a waveguide transition with a mode filter card in place.
Figure 13:
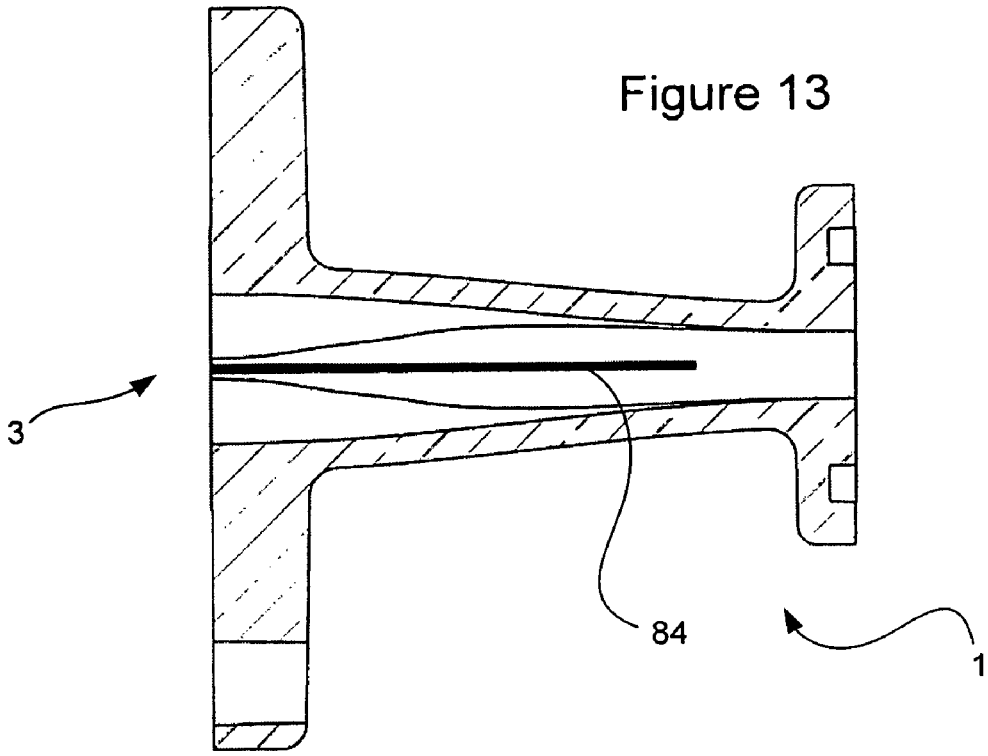
FIG. 13 is a second cross-section of a waveguide transition with a mode filter card in place.

FIG. 12 is a cross-section of a waveguide transition showing the mode filter card in place. The filter may take up approximately 75% of the transition length, ensuring that there is adequate filtering in that part of the transition which is dimensioned such that higher modes may exist. This percentage of the transition length may be different depending on transition length, resistivity of the resistive coating and desired attenuating properties of the mode filter. FIG. 13 is a second cross-section, showing the transition from the side. With the filter positioned in this way, unwanted higher modes induce a current in the resistive coating. This current experiences losses because of the resistance of the coating, effectively attenuating the higher modes. The desired signals in the fundamental mode pass by without inducing a current in the resistive coating and therefore with significantly lower attenuation.

Figure 14:
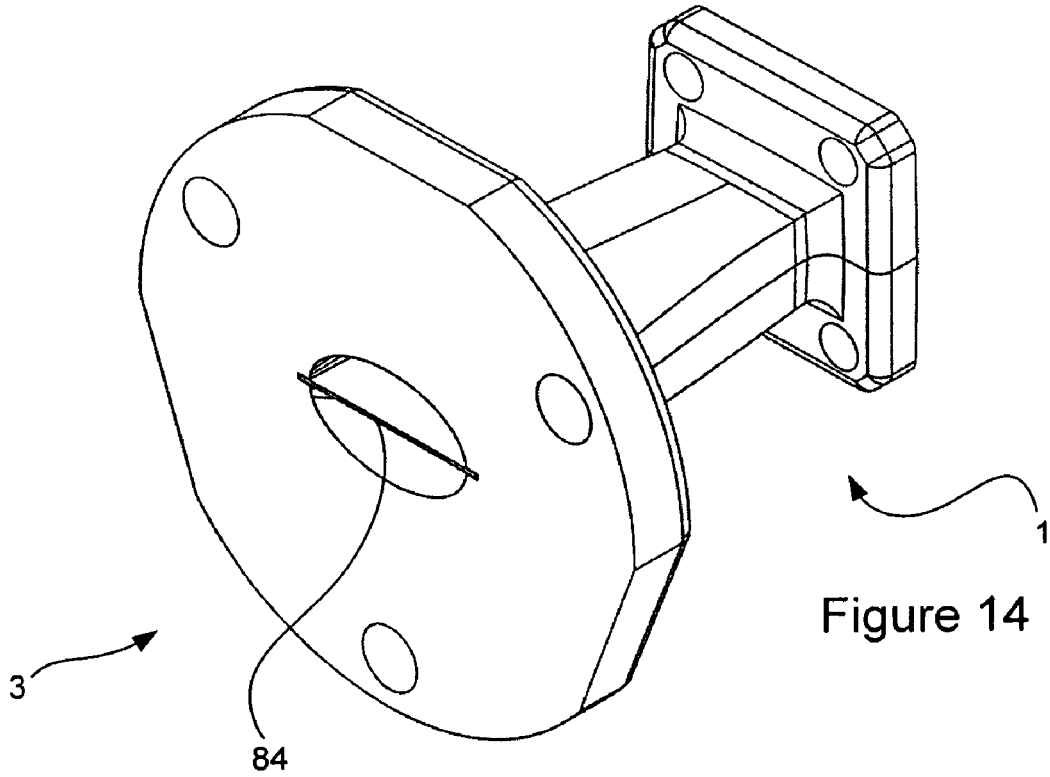
FIG. 14 is a perspective view of a waveguide transition with a mode filter card in place.

In use, a mode filter is simply fitted to the slots 74 and 75 at the elliptical end and slid into position before attachment of an elliptical overmoded waveguide to the transition. FIG. 14 shows a perspective view of the transition 1 from the elliptical end 3, with the mode filter card 84 in place.

Figure 15:
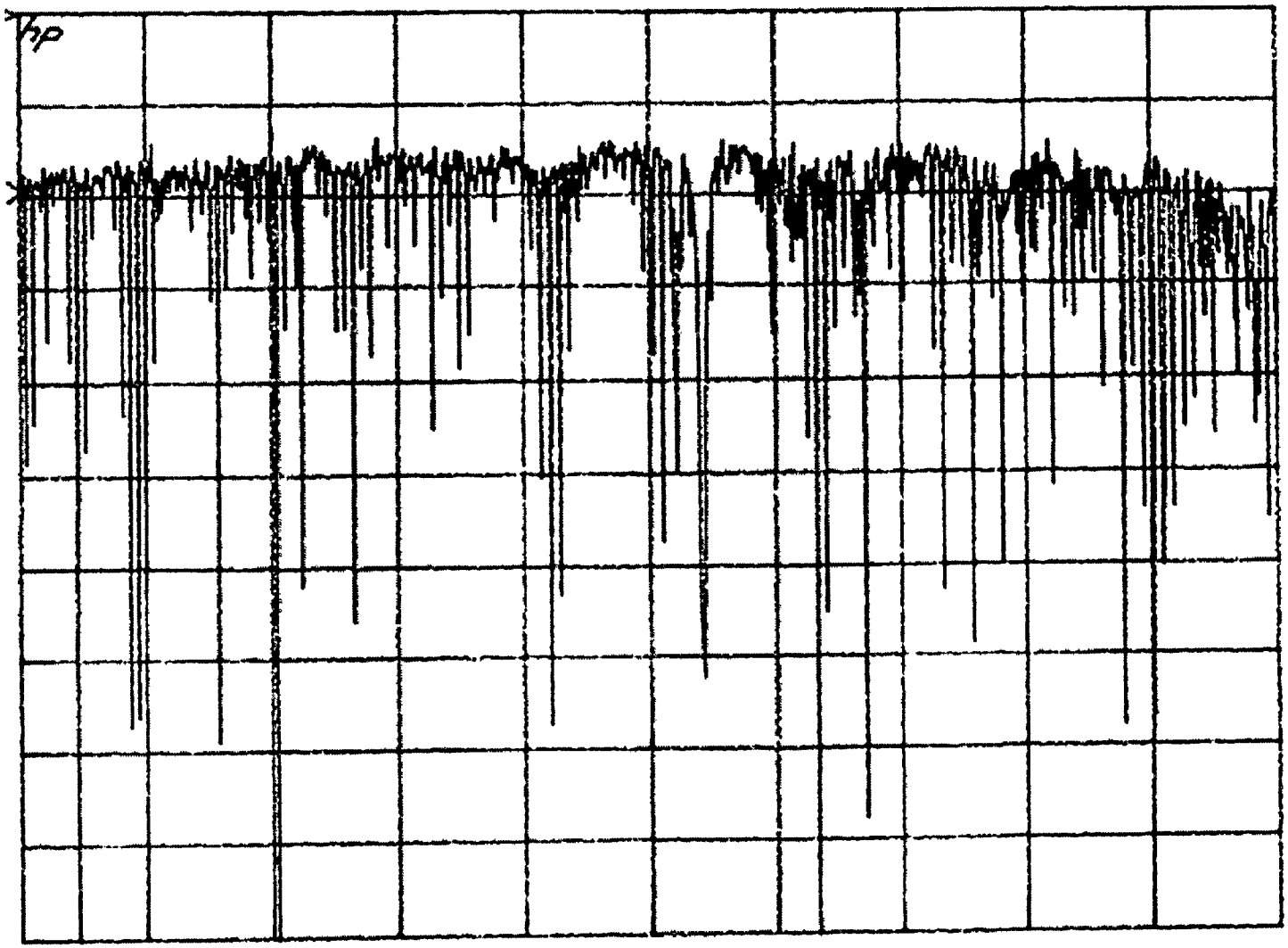
FIG. 15 is a plot illustrating the performance of a prior art waveguide transition as a function of frequency.

This transition has been found experimentally to have excellent performance. FIG. 15 shows a plot of insertion loss as a function of frequency for a conventional waveguide transition with no mode filtration. This plot therefore illustrates the inherent mode conversion of this transition. The conventional transition is a transition for connecting an elliptical overmoded waveguide to a rectangular dominant mode waveguide, and has an internal shape consisting of an elliptical bore intersecting a rectangular pyramid.

Figure 16:
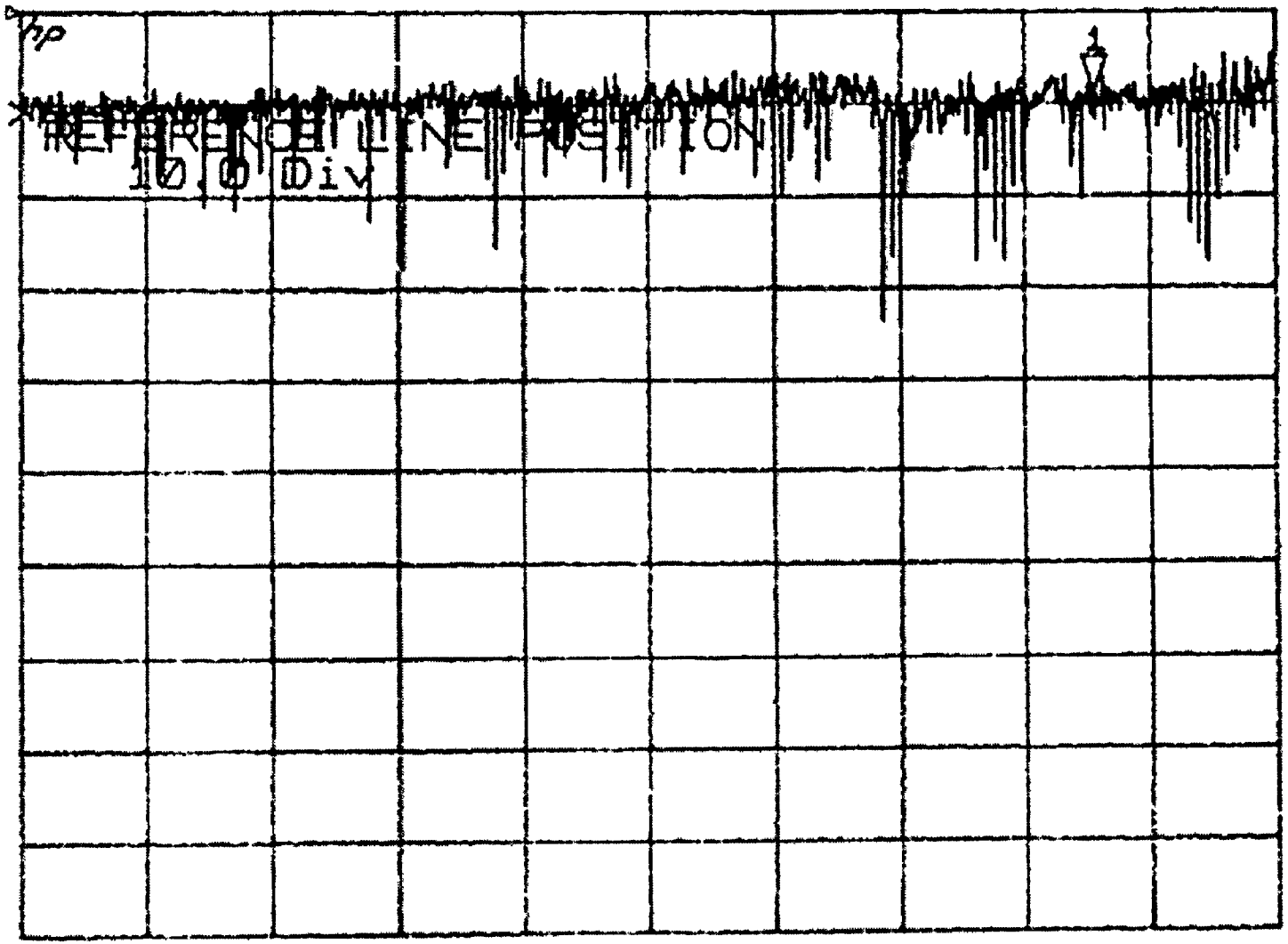
FIG. 16 is a plot illustrating the performance of one embodiment of the applicant's waveguide transition as a function of frequency.

The left edge of the plot is at 26.5 GHz, while the right hand edge is at 40.0 GHz. The large loss spikes occur at each mode cutoff frequency and the amplitude of the spike shows the relative loss due to mode reconversion. Low mode conversion is desirable, so low amplitude of these spikes is an indication of superior performance. FIG. 16 shows a similar plot to that of FIG. 15, for the applicant's transition fabricated according to the embodiment described above. The scale is identical to that of FIG. 15, and it is clear that the amplitude of the spikes is significantly lower than the existing product (about 25%), indicating that mode conversion is significantly lower in the applicant's transition than in the conventional transition.

This lower mode conversion allows the applicant's transition to be used with a much lower level of mode filtration. Since mode filtration necessarily also attenuates the desired fundamental mode signals, the applicant's transition can provide similar levels of unwanted higher mode signals to existing products and a dramatic reduction in fundamental mode attenuation. Alternatively, higher levels of mode filtering could be used, to achieve significantly lower levels of unwanted higher mode signals than in existing products and a similar level of fundamental mode attenuation.

The applicant's transition also provides very low voltage standing wave ratio (VSWR) over a very wide band, a critical requirement for a waveguide transition.

In use, such transitions may be installed at each end of a length of elliptical overmoded waveguide. So a waveguide system may include a rectangular dominant mode waveguide input, a first transition from the rectangular waveguide to an elliptical overmoded waveguide, a length of elliptical overmoded waveguide, and a second transition from the elliptical overmoded waveguide to a rectangular dominant mode waveguide output. This creates a cavity between the two transitions, within which the unwanted higher modes propagate, unable to pass through the transition and into the dominant mode waveguide because of its cutoff frequency. Preferably, these higher modes should be effectively filtered and should not convert back to the fundamental mode, since this causes signal distortion.

The principle reason for using elliptical overmoded waveguide over rectangular overmoded waveguide is the inherent flexibility of elliptical waveguide. This provides greater ease of installation since the waveguide can simply be bent if necessary, avoiding the troublesome alignment and joining required with rectangular waveguides. Typically an elliptical waveguide will have a minimum bend radius.

Testing was again conducted on the prior art waveguide transition and the applicant's transition in the following manner. A waveguide system was set up, with a length of elliptical waveguide and two transitions, forming a cavity supporting higher modes. The maximum peak-to-peak ripple in the insertion loss was measured over the operating frequency range ("the higher mode level"). A first measurement of the higher mode level was taken with the elliptical waveguide in a substantially straight configuration, and a second measurement was taken with two 90° bends formed in the elliptical waveguide at the minimum bend radius of the waveguide. For the prior art waveguide, the higher mode level increased from 0.23 dB to 1.0 dB. In contrast, the applicant's transition was essentially the same whether the waveguide was straight or bent, being 0.23 dB in both configurations.

This result shows that the higher modes resulting from mode conversion caused by the bend in the elliptical waveguide are effectively filtered by the applicant's mode filtering arrangement. It also shows that the higher modes are not being converted back to the fundamental mode by the transition.

A method of fabrication of a waveguide component for guiding or coupling electromagnetic waves will now be described. The component may be a waveguide transition (including, but not limited to, a taper transition for transitioning between any combination of rectangular, elliptical, circular or square waveguides, such as rectangular-to-rectangular, rectangular-to-elliptical, rectangular-to-square, elliptical-to-circular, elliptical-to-elliptical etc; and any combination of dominant mode and overmoded waveguides). The component may also be a transition for transitioning between a coaxial transmission line and a waveguide of any cross-section. The component may also be a waveguide connector or joint, or any other suitable component.

The waveguide component may be designed such that its shape allows it to be formed in a single piece. Since the method involves a casting process, this means that the internal shape of the component should be advantageously configured for removal of a mold core after casting. This internal shape may be an internal taper, allowing the mold core to be removed from one end of the component. The internal taper may be a continuous, smooth taper from one end of the component to the other. Such removal of the mold core also allows reuse of this part, which is of course desirable from a cost perspective.

Formation in a single piece provides a component with a better quality inner surface, without the joins necessary in component made in two or more pieces. Such joins may cause undesirable reflections and/or mode conversion. Also, further assembly and/or machining steps are not required where the component is formed in a single piece.

The waveguide component is capable of fabrication by thixoforming. This is a casting process, which allows fabrication with extremely precise tolerances. A metallic material is introduced into a thixotropic state, in which both liquid and solid phases are present. This may be performed by heating a stock material. Shear forces may be applied, preventing the formation of structures in the thixotropic material. The material is then injection molded in this thixotropic state. A suitable thixoforming process is that used by Thixomat, Inc of Ann Arbor, Mich. Other processes may also be suitable.

The metallic material may be a metal alloy, and in particular may be a magnesium alloy, such as alloy AZ91D. This alloy is composed principally of magnesium with other elements in the following proportions:

8.3-9.7% Al;

0.15% Mn (minimum);

0.35-1.0% Zn;

0.10% Si (maximum);

0.005% Fe (maximum);

0.030% Cu (maximum);

0.002% Ni (maximum); and 0.02% Other elements (maximum, each).

Magnesium alloy is mechanically strong and is generally somewhat lighter and less costly than the copper-based materials previously used in waveguide components made by electroforming.

This fabrication method allows accurate fabrication of a waveguide component. Unlike conventional casting processes, no binder or sintering is generally required and the process may allow very tight tolerance control (approximately ±0.001"). The component, when released from its mold and with the mold core removed may be substantially in its finished state, requiring little additional machining. Features such as flanges, slots, grooves, apertures for coupling to waveguides or waveguide components, etc may be formed during the molding process. This is in contrast to other fabrication methods, which either require additional fabrication steps or do not produce the required precision. However, formation of the component in a single piece, as described herein, means that the internal shape of the component is formed as a single piece. Of course, this single piece may subsequently be joined to any number of external features, such as flanges and the like, and remain within the scope of the invention.

The fabrication process described above may be advantageous for fabrication of waveguide components and transitions in general. The fabrication method may be especially advantageous for fabrication of transitions for connecting an overmoded waveguide to another waveguide, because of the tight tolerances required for avoidance of mode conversion. The waveguide transition described above requires extremely precise fabrication, to give a smooth and accurate internal surface, and this fabrication method meets these criteria. Furthermore, this transition is designed with a continuous internal taper and with the mode filter slot exiting at the wider end. This enables removal of a mold core after formation.

While the waveguide transition described above transitions from a dominant mode rectangular waveguide to an elliptical overmoded waveguide, similar transitions are also within the scope of the invention, including: transitions from rectangular overmoded waveguides to elliptical overmoded waveguides; and transitions from rectangular overmoded waveguides to elliptical dominant moded waveguides. In a transition from a rectangular overmoded waveguide to an elliptical dominant moded waveguide, the rectangular end will be of dimensions generally larger than the elliptical end. However, the same principles and mathematical functions set out above can be used in such a transition.

As is well-known in the art, the term "elliptical" as commonly applied to waveguides is merely an approximation, and does not necessarily imply a shape meeting the mathematical criteria of a true ellipse. As used in this specification, the term "elliptical" or "ellipse" is intended to embrace not just cross-sectional configurations which are mathematically true ellipses, but also cross-sectional configurations which are oval, circular, quasi-elliptical, or super-elliptical (as described in U.S. Pat. No. 4,642,585, for example). Thus, the invention is applicable to any of these cross-sectional configurations, including the more or less oval-shaped configurations commonly called "elliptical" in the waveguide art. Although it is convenient for explanation of the invention to consider the case where the top and bottom walls of the transition are elliptical arcs of a mathematical ellipse, the invention is not to be limited to such mathematical ellipses. A circular waveguide is simply a special case of an elliptical waveguide, and is intended to be within the scope of the invention. Similarly, a square waveguide is a special case of a rectangular waveguide and is also intended to be within the scope of the invention.

Although the waveguide transition may be described herein as transitioning from a rectangular waveguide to an elliptical waveguide, or from a dominant mode waveguide to an overmoded waveguide, the transition is adapted to transmit signals in both directions. Similarly, although the transition may be described as having an input end and an output end, this is simply for convenience of description and should not be taken as limiting.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A waveguide transition for transitioning from a rectangular waveguide to an elliptical waveguide, at least one of the waveguides being an overmoded waveguide, the transition having a transition passage, said transition passage including:

i. a rectangular end having a rectangular cross-section and an elliptical end having an elliptical cross-section, at least one of the rectangular and elliptical ends having a cross-section dimensioned to support overmoded transmission; and ii. internal top, bottom and side walls connecting the rectangular end and the elliptical end;

wherein:

a. the cross-sectional shape of the top and bottom walls varies continuously between straight at the rectangular end and semi-elliptical at the elliptical end;

b. the top and bottom walls are shaped to join smoothly with a passage of rectangular cross-section at the rectangular end and with a passage of elliptical cross-section at the elliptical end;

c. the cross-sectional shape of the side walls is straight or convex at all points between the rectangular end and the elliptical end, the height of the side walls diminishing continuously along the length of the transition, being larger at the rectangular end than at the elliptical end;

d. the side walls are shaped to join smoothly with a passage of rectangular cross-section at the rectangular end; and e. the transition passage is configured to support a mode filter by further including one or more slots formed in the internal walls.

2. A waveguide transition as claimed in claim 1 wherein a slot is formed in each internal side wall, the slots being configured to receive a mode filter and retain it in the H plane.

3. A waveguide transition as claimed in claim 1 wherein the slots open onto the elliptical end, allowing a mode filter to be slid into the slots from the elliptical end.

4. A waveguide transition as claimed in claim 1, wherein:

each of the top and bottom walls defines a smooth curve in the E plane between the rectangular end and the elliptical end, the curve being capable of definition by an equation of lateral displacement from the axis of the transition as a function of displacement along the length of the transition; and the first derivative of that equation is zero at each end of the transition and the second derivative of that equation changes sign along the length of the transition.

5. A waveguide transition as claimed in claim 4 wherein the equation is given by:

$$D=(B/2)\cos^2(\pi z/2L)+b\sin^2(\pi z/2L)$$

where D is the lateral displacement of the top or bottom wall from the transition axis in the E plane, B is the height at the rectangular end, b is the semi-minor axis at the elliptical end, z is the displacement along the length of the transition from the rectangular end, and L is the total length of the transition.

6. A waveguide transition as claimed in claim 5 wherein the cross-sectional shape of each of the top and bottom walls at any point between the rectangular and elliptical ends is substantially that of an elliptical arc, the arc satisfying the elliptical equation:

$$(x^2/C^2)+(y^2/D^2)=1$$

where C=a/[sin(πz/2L)], and a is the semi-major axis at the elliptical end.

7. A waveguide transition as claimed in claim 1, wherein:

each of the side walls defines a smooth curve in the H plane between the rectangular end and the elliptical end, the curve being capable of definition by an equation of lateral displacement from the axis of the transition as a function of displacement along the length of the transition; and the first derivative of that equation is zero at the rectangular end of the transition.

8. A waveguide transition as claimed in claim 7 wherein the equation is given by:

$$X=a-(a-A/2)\cos[(\pi z/2L)]$$

where X is the lateral displacement of the side wall from the transition axis in the H plane, a is the semi-major axis at the elliptical end, A is the width of the rectangular end, z is the displacement along the length of the transition from the rectangular end, and L is the total length of the transition.

9. A waveguide transition as claimed in claim 1 wherein the cross-sectional shape of each of the top and bottom walls at any point between the rectangular and elliptical ends is substantially that of an elliptical arc, the eccentricity of the elliptical arc diminishing along the length of the transition.

10. A waveguide transition as claimed in claim 1 for transitioning from a rectangular dominant mode waveguide to an elliptical overmoded waveguide, the rectangular end having a cross-section dimensioned to support dominant mode transmissions in a frequency range and the elliptical end having a cross-section dimensioned to support overmoded transmissions in the frequency range.

11. A waveguide transition as claimed in claim 1 wherein the height of the side walls diminishes substantially to zero at the elliptical end.

12. A manufacturing method comprising:

i. casting the waveguide transition of claim 1 by employing a thixoforming process; and ii. establishing a mode filter within the transition passage.

13. A waveguide system including:

i. a dominant mode input;

ii. a dominant mode output;

iii. a length of overmoded waveguide between the dominant mode input and the dominant mode output;

iv. a first waveguide transition transitioning from the dominant mode input to the overmoded waveguide; and v. a second waveguide transition transitioning from the overmoded waveguide to the dominant mode output;

wherein at least one of the first and second waveguide transitions is a waveguide transition as claimed in claim 1.

14. A waveguide transition comprising:

i. a casting defining an internal passage extending therethrough having a first end of rectangular cross-section and a second end of non-rectangular cross-section, the cross-section of said passage at one of the first and second ends being shaped and dimensioned to support dominant mode transmissions at a signal frequency, and the cross-section of said passage at the other of the first and second ends being shaped and dimensioned to support overmoded transmissions at the signal frequency; and ii. a metallic mode filter mounted within said passage and configured and positioned to suppress unwanted higher modes more than signals at the signal frequency.

15. The waveguide transition of claim 14 wherein the metallic mode filter is a mode filter card longitudinally mounted to bisect said passage.

16. The waveguide transition of claim 15 wherein the metallic mode filter card comprises a metallic coating formed on a substrate.

17. The waveguide transition of claim 14, wherein the waveguide transition further comprises thixoformed material for low cost and lightweight, said internal passage having walls of such smoothness as to minimize creation of surface-induced mode conversions in the passage.

18. A waveguide transition of claim 14 in the form of a one-piece casting having slots on opposed sides of said passage located and configured to receive said mode filter.

19. The waveguide transition of claim 18 wherein the slots are formed in opposing internal walls of the transition without penetrating to the exterior through those walls.

20. The waveguide transition of claim 14 wherein said passage transitions between rectangular cross-section at the first end and elliptical cross-section at the second end, and wherein opposed first and second passage walls are concave and characterized by a first derivative being substantially zero at the first and second ends of the passage, and by a second derivative changing sign between the first and second ends of the passage.

21. The waveguide transition of claim 14 wherein said passage transitions between rectangular cross-section at the first end and elliptical cross-section at the second end, and wherein opposed third and fourth passage walls are characterized by a first derivative being substantially zero at the first end of the passage, and by said third and fourth walls flaring out from the first end to the second end of the passage and reducing in height substantially to zero at the second end of the passage.

22. The waveguide transition of claim 14, wherein the waveguide transition further comprises a one-piece casting of thixoformed material for low cost and light weight, said passage having walls of such smoothness as to minimize creation of surface-induced mode conversions in the passage and having slots on opposed sides thereof located and configured to receive said mode filter.

23. The waveguide transition of claim 22 wherein said passage transitions between rectangular cross-section at the first end and elliptical cross-section at the second end, and wherein opposed first and second passage walls are concave and characterized by a first derivative being substantially zero at the first and second ends of the passage, and by a second derivative changing sign between the first and second ends of the passage.

24. The waveguide transition of claim 23 wherein said passage transitions between rectangular cross-section at the first end and elliptical cross-section at the second end, and wherein opposed third and fourth passage walls are characterized by a first derivative being substantially zero at the first end of the passage, and by said third and fourth walls flaring out from the first end to the second end of the passage and reducing in height substantially to zero at the second end of the passage.

25. The waveguide transition of claim 22 wherein the transition is tapered from a narrow end to a wide end and wherein the slots open onto the wide end of the transition, the internal shape formed thereby being configured for removal of a mold core.

26. The waveguide transition of claim 14 wherein the metallic mode filter extends along a portion of the internal passage in which unwanted higher modes are able to exist.

27. The waveguide transition of claim 26 wherein the metallic mode filter card extends along about 75% of the length of the transition, from the end shaped and dimensioned to support overmoded transmissions.

28. A waveguide system including:

i. a dominant mode input;

ii. a dominant mode output;

iii. a length of overmoded waveguide between the dominant mode input and the dominant mode output;

iv. a first waveguide transition transitioning from the dominant mode input to the overmoded waveguide; and v. a second waveguide transition transitioning from the overmoded waveguide to the dominant mode output;

wherein at least one of the first and second waveguide transitions is a waveguide transition as claimed in claim 14.

* * * * *